US010149580B1

(12) United States Patent
Al-Heraibi

(10) Patent No.: US 10,149,580 B1
(45) Date of Patent: Dec. 11, 2018

(54) TISSUE BOX WITH IMPROVED TISSUE DISPENSING

(71) Applicant: Abdulrahman Saleh Al-Heraibi, Safat (KW)

(72) Inventor: Abdulrahman Saleh Al-Heraibi, Safat (KW)

( * ) Notice: Subject to any disclaimer, the term of this patent is extended or adjusted under 35 U.S.C. 154(b) by 0 days.

(21) Appl. No.: 16/019,367

(22) Filed: Jun. 26, 2018

(51) Int. Cl.
*B65D 83/08* (2006.01)
*A47K 10/42* (2006.01)
*B65H 3/56* (2006.01)

(52) U.S. Cl.
CPC ..... *A47K 10/421* (2013.01); *B65D 83/0835* (2013.01); *B65H 3/56* (2013.01); *B65H 2301/4234* (2013.01)

(58) Field of Classification Search
None
See application file for complete search history.

(56) References Cited

U.S. PATENT DOCUMENTS

| | | | | |
|---|---|---|---|---|
| 3,094,323 | A | 6/1963 | Catania | |
| 3,248,006 | A | 4/1966 | Lowery et al. | |
| 4,739,902 | A | 4/1988 | Joslyn et al. | |
| 4,946,066 | A | 8/1990 | Teitelman | |
| 5,097,984 | A | 3/1992 | Meisner et al. | |
| 5,322,190 | A | 6/1994 | Bartley | |
| 7,661,554 | B2 | 2/2010 | Szymonski et al. | |
| 9,624,026 | B1 | 4/2017 | Al-Heraibi | |
| 2007/0262086 | A1* | 11/2007 | Cook | B65D 5/001 221/305 |
| 2009/0277922 | A1* | 11/2009 | Lifschitz | B65D 83/0805 221/30 |
| 2014/0124525 | A1* | 5/2014 | Delaney | A47K 10/38 221/34 |

FOREIGN PATENT DOCUMENTS

| | | | |
|---|---|---|---|
| WO | 9617794 | A1 | 6/1996 |

* cited by examiner

*Primary Examiner* — Gene O Crawford
*Assistant Examiner* — Ayodeji T Ojofeitimi
(74) *Attorney, Agent, or Firm* — Richard C. Litman

(57) ABSTRACT

The tissue box with improved tissue dispensing may have an auxiliary device or tool for frictionally engaging and manipulating a tissue contained within the tissue box. The tissue box includes a top wall, a bottom wall, a pair of longitudinally opposed end walls, and a pair of laterally opposed sidewalls, and a longitudinally extending slot formed through the top wall. The device for frictionally engaging and manipulating the tissue is a finger cot having a closed end and an open end, the closed end thereof being positioned adjacent the longitudinally extending slot. The finger cot is secured to the top wall of the tissue box by a flexible, resilient sheet or band. The band has first and second longitudinally opposed ends, the first end being secured to the top wall of the tissue box and the second end being secured to the open end of the finger cot.

17 Claims, 12 Drawing Sheets

TISSUE BOX WITH IMPROVED TISSUE DISPENSING

BACKGROUND

1. Field

The disclosure of the present patent application relates to tissue boxes, and particularly to a tissue box with improved tissue dispensing.

2. Description of the Related Art

Tissue boxes are used in many homes and offices for dispensing tissues and similar items. Tissues are convenient toiletry items that have many uses in addition to covering or wiping one's mouth, nose, or face, such as a replacement for napkins, or for wiping dirt and wastes from surfaces. The most prevalent use, however, arises in times of sickness or allergies, when one has to cope with runny nasal passages and expectoration from coughs and sneezes. When trying to remove a tissue from a conventional tissue box, particularly when the user is distracted and weakened by illness or allergies, it may be difficult to only remove a single tissue from the stack of tissues contained within the tissue box. Additionally, an extended or uncoordinated attempt to remove a single tissue may give rise to the transmission of harmful germs to the remaining tissues in the tissue box. It would obviously be desirable to assist the user in the removal of tissues from the tissue box in a hygienic manner. Thus, a tissue box with improved tissue dispensing solving the aforementioned problems is desired.

SUMMARY

The tissue box with improved tissue dispensing provides various embodiments of tissue boxes with improvements to the box or devices attached to the box to improve dispensing or removing tissues from the box. In one embodiment, the box has an auxiliary device or tool for frictionally engaging and manipulating a tissue contained within the tissue box. The tissue box with improved tissue dispensing includes a tissue box having a top wall, a bottom wall, a pair of longitudinally opposed sidewalls or end walls, and a pair of laterally opposed sidewalls. A longitudinally extending slot is formed through the top wall. The device or tool for frictionally engaging and manipulating the tissue is a rubber fingertip or finger cot having a closed end and an open end, the closed end being positioned adjacent the longitudinally extending slot. The finger cot is secured to the top wall of the tissue box by a flexible, resilient sheet. The sheet has first and second longitudinally opposed ends, the first end being secured to the top wall of the tissue box and the second end being secured to the open end of the finger cot.

The finger cot is adapted for receiving a fingertip of a user such that the finger cot may be inserted into the interior of the tissue box through the longitudinally extending slot for engaging and manipulating a top-most tissue contained therein. The finger cot may be made from rubber, either natural or synthetic, and the closed end thereof may be at least partially coated with an adhesive for releasably adhering to the tissue. Additionally, a releasable cover may be provided for selectively covering the sheath when not in use, thus preventing drying of the adhesive. The finger cot is particularly useful for retrieving a tissue that has fallen into the box.

In an alternative embodiment, the tissue box may have at least one hanging tab attached thereto. The hanging tab has an aperture defined therein and is adapted for releasable hanging from an external support, such as a wall hook or the like. The hanging tab may be formed from a double layer of nylon or other plastic material. The hanging tab may be attached to any suitable portion of the tissue box. For example, a portion of one layer may be adhesively attached to the bottom wall and a portion of the second layer may be adhesively attached to one of the pair of laterally opposed sidewalls to attach the hanging tab to a corner edge of the box. Alternatively, the hanging tab may be secured to the center of the bottom wall of the box by a strip of adhesive tape.

In a further alternative embodiment, the tissue box may have a top wall formed with a truncated pyramidal shape, elevating the top wall above the stack of tissues to provide more room inside the box to maneuver the tissue so that the tissue is not torn in the process of removing the tissue from the box. The truncated pyramidal shape of the top wall may be defined by a pair of longitudinally opposed end panels having a substantially triangular form and a pair of laterally opposed panels having a substantially trapezoidal form.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
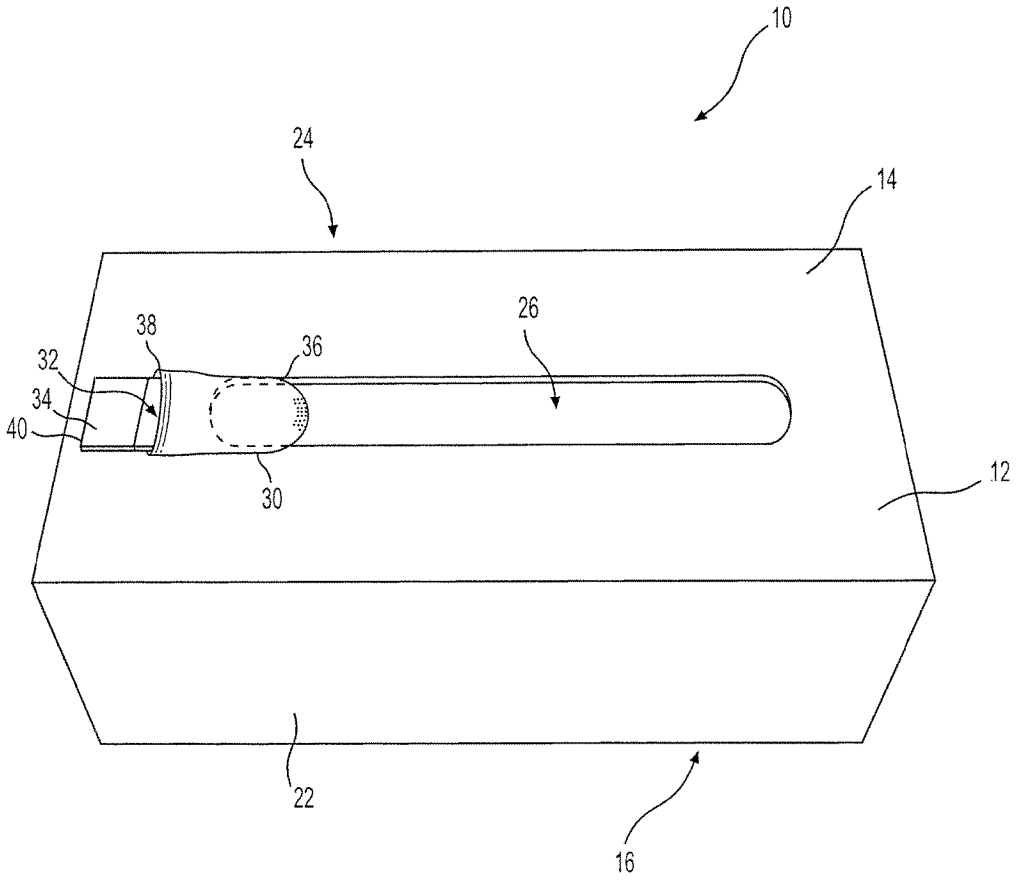
FIG. 1 is a perspective view of a first embodiment of a tissue box with improved tissue dispensing.
Figure 2:
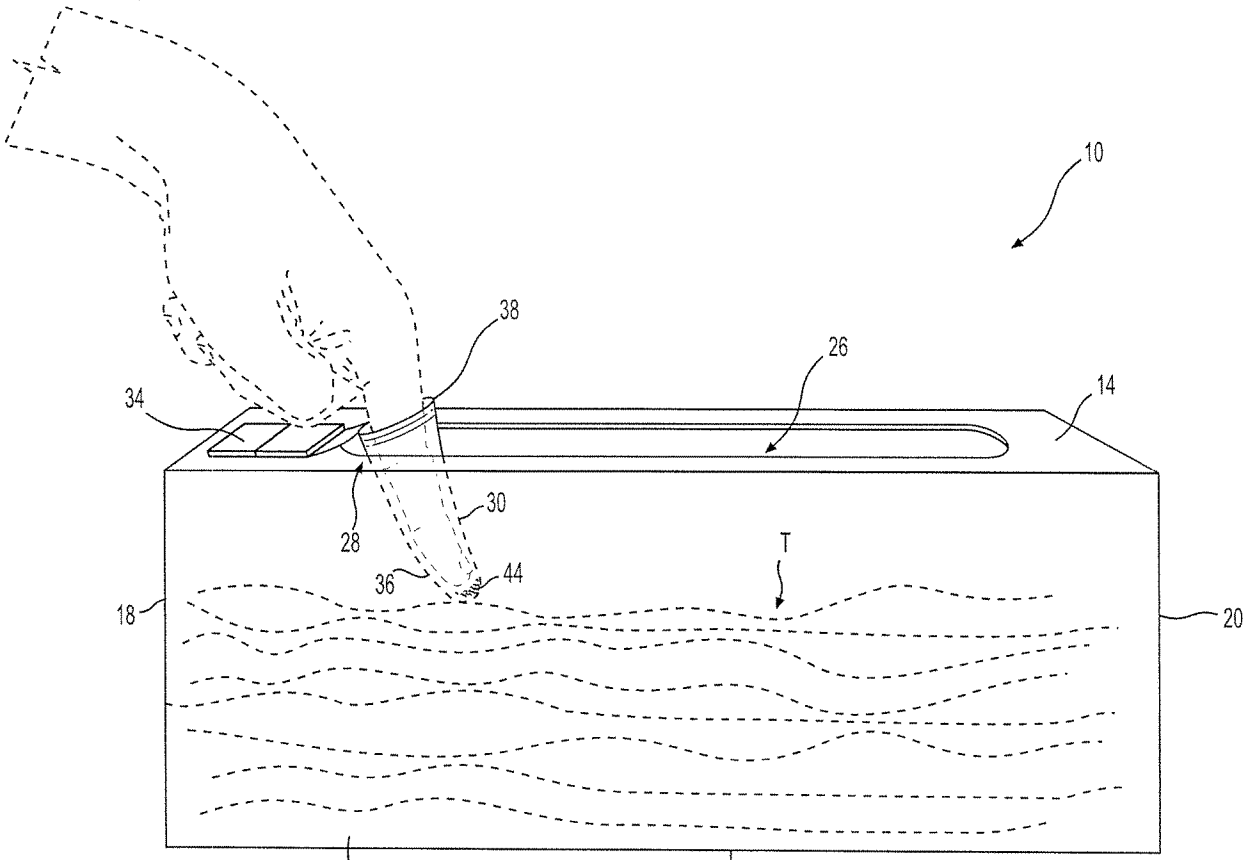
FIG. 2 is an environmental perspective view of the tissue box of FIG. 1, shown with a user engaging a topmost tissue with his index finger using the attached finger cot.
Figure 3:
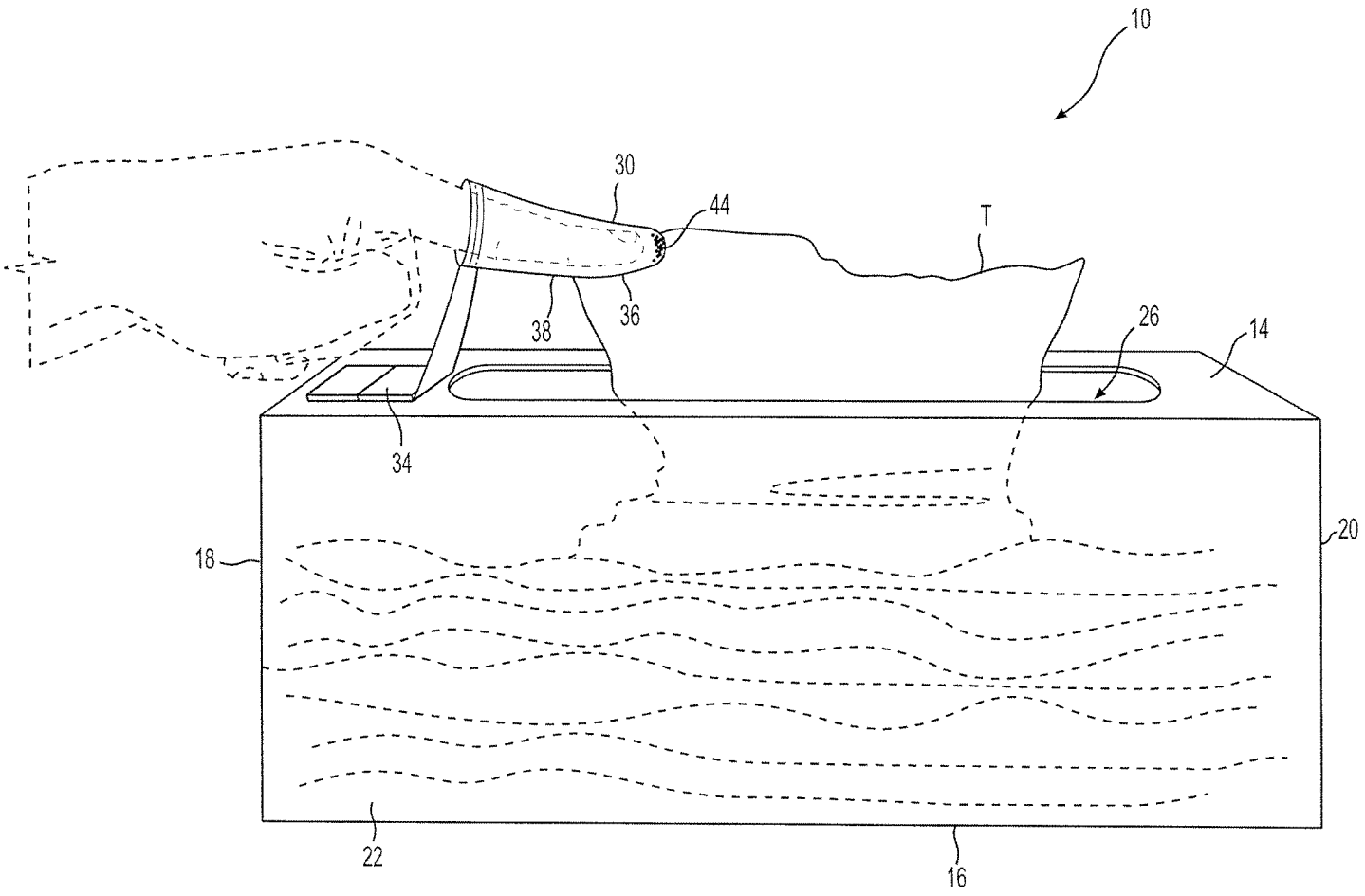
FIG. 3 is an environmental perspective view of the tissue box of FIG. 1, shown with the topmost tissue partially withdrawn from the box.

As shown in FIGS. 1-3, in a first embodiment, the tissue box with improved tissue dispensing, designated generally as 10 in the drawings, includes an auxiliary device or tool for engaging and manipulating a tissue T contained within the tissue box 10. The tissue box 10 includes a box 12 having a top wall 14, a bottom wall 16, a pair of longitudinally opposed sidewalls or end walls 18, 20 and a pair of laterally opposed sidewalls 22, 24. It should be understood that the overall dimensions and configuration of the tissue box 12 are shown for exemplary purposes only, and that the tissue box 12 may have any desired configuration, such as a small cubicle tissue box or the like. A longitudinally extending slot 26 is formed through the top wall 14 for dispensing tissues T.

Figure 4:
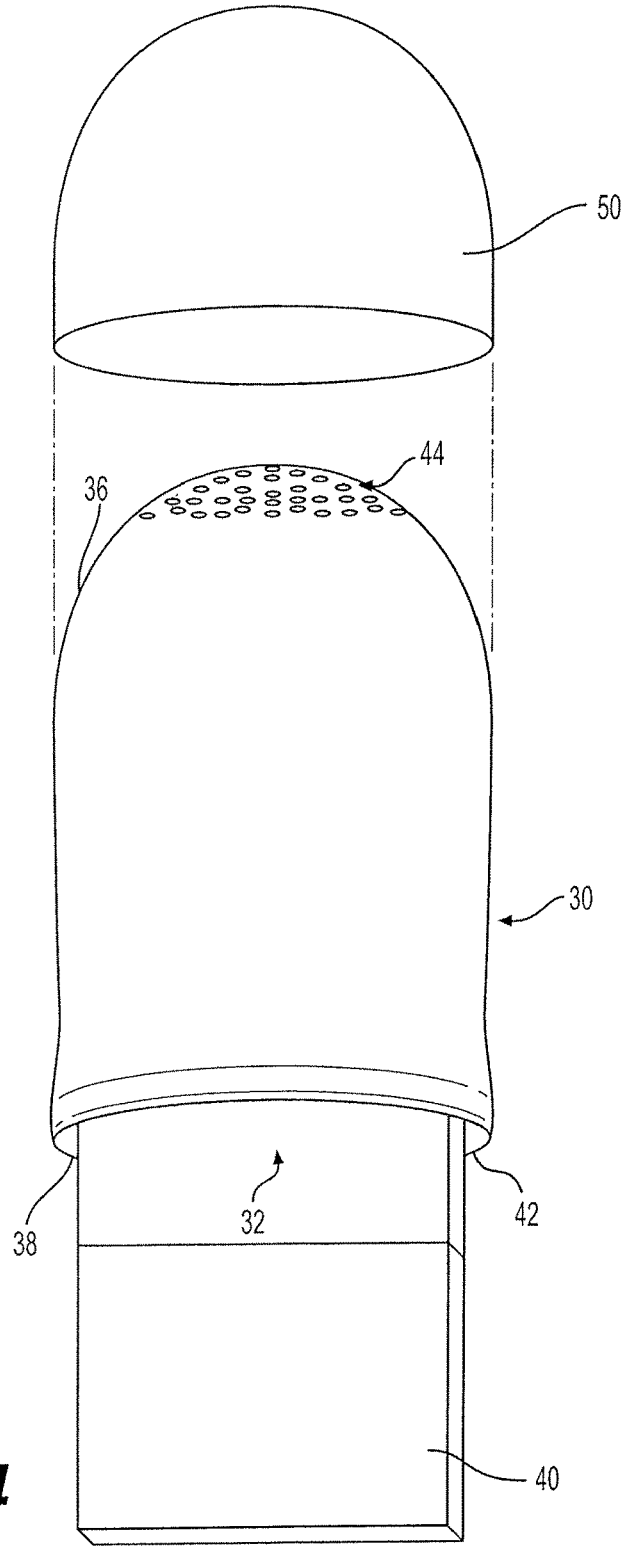
FIG. 4 is an exploded view of a finger cot with a releasable cover removed from the tip of the cot, the finger cot being shown detached from the tissue box.

The device or tool for engaging and manipulating the tissue T is in the form of a rubber fingertip or finger cot 30 having a closed end 36 and an open end 38, the closed end 36 being positioned adjacent the longitudinally extending slot 26. The finger cot 30 is preferably dimensioned and configured for receiving a user's index finger or fingertip, such that the user may easily insert the fingertip through open end 38 to be comfortably received within the interior 32 of the finger cot 30. The finger cot 30 is secured to the top wall 14 of the tissue box 12 by a by a flexible, resilient sheet or band 34. As best shown in FIGS. 1 and 4, the band 34 has first and second longitudinally opposed ends 40, 42, respectively, with the first end 40 secured to the top wall 14 of the tissue box 12 and the second end 42 being secured to the open end 38 of the finger cot 30.

As best shown in FIGS. 2 and 3, the finger cot 30 is adapted for receiving a fingertip of the user such that the sheath 30 may be inserted into the interior of the tissue box 12 through the longitudinally extending slot 26 for engaging and manipulating the top-most tissue T contained therein. The band 34 is flexible and resilient, allowing the finger cot 30 to stretch through the slot 26 into the interior of the box 12, and then returning the finger cot 30 to the exterior of the top wall 14 adjacent the slot 26 when the user's fingertip is removed. Returning to FIG. 4, the finger cot 30 may be made from rubber, either natural or synthetic, latex, nitrile, or the like, and the closed end 36 may be at least partially coated with an adhesive 44 for releasably adhering to the tissue T to draw the tissue out through the slot 26. Additionally, a releasable paper 50 may be provided for selectively covering the finger cot 30 when not in use, thus preventing drying of the adhesive 44.

Figure 5:
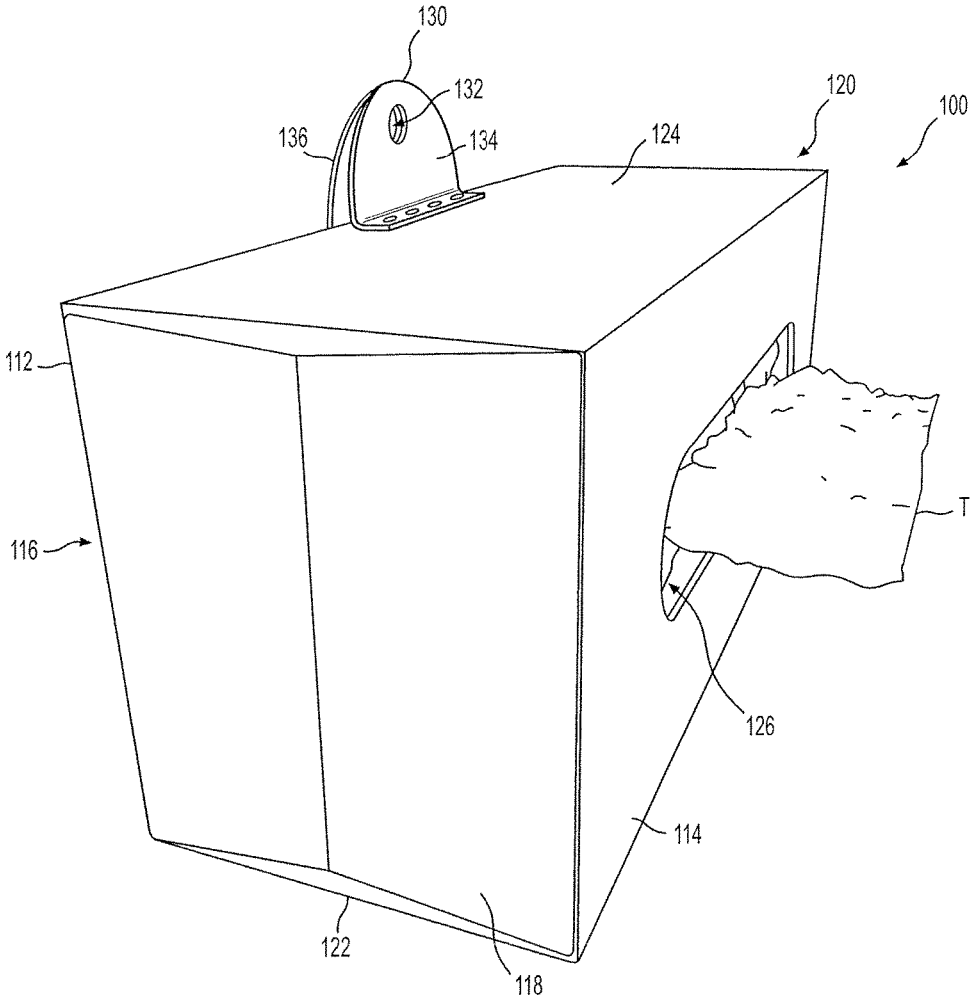
FIG. 5 is a perspective view of an alternative embodiment of a tissue box with improved tissue dispensing, the box having a single hanging tab configured for hanging the box laterally from a vertical support.
Figure 6:
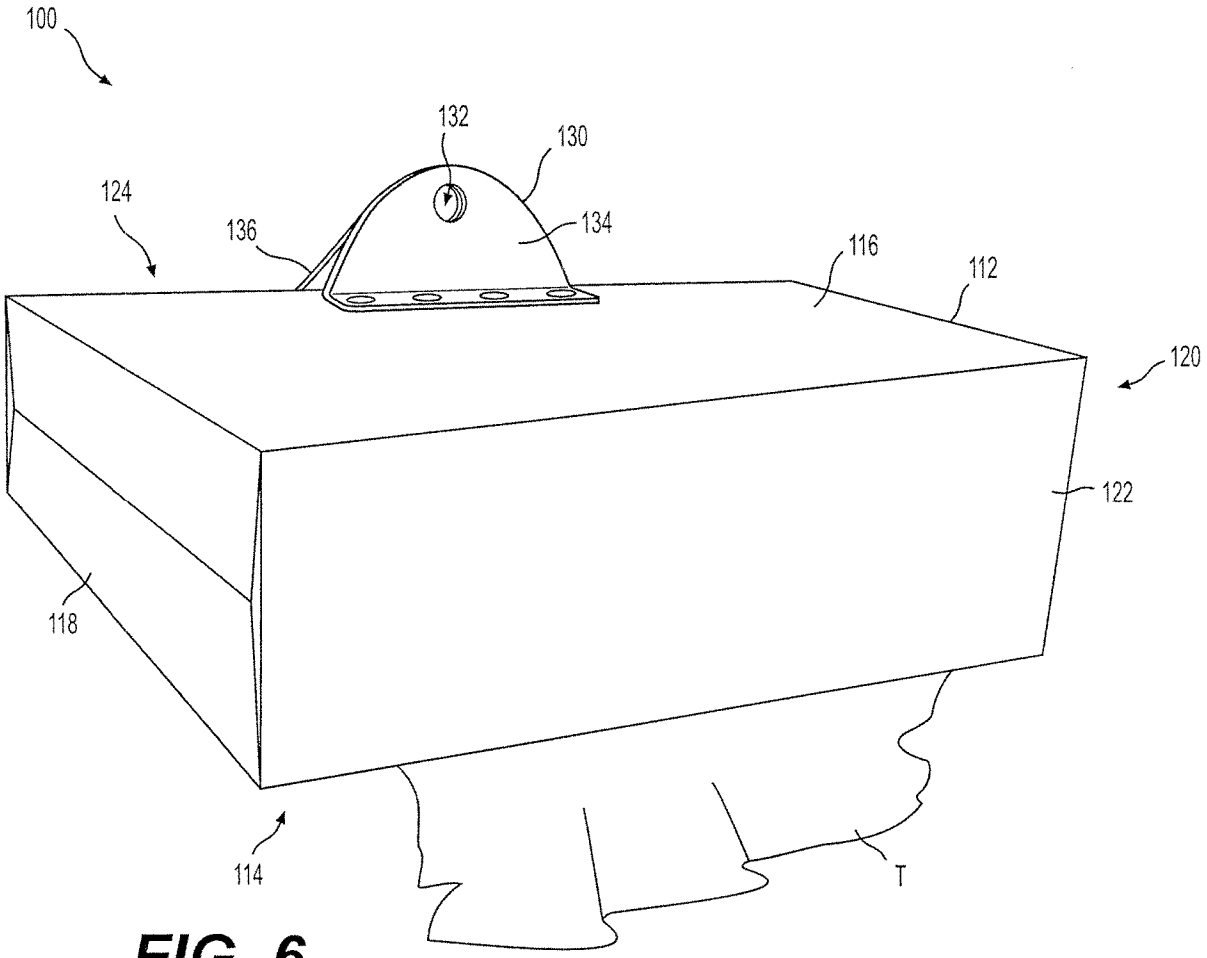
FIG. 6 is a perspective view of an alternative embodiment of a tissue box with improved tissue dispensing, the box having a single hanging tab configured for hanging the box upside down from a vertical support.
Figure 7:
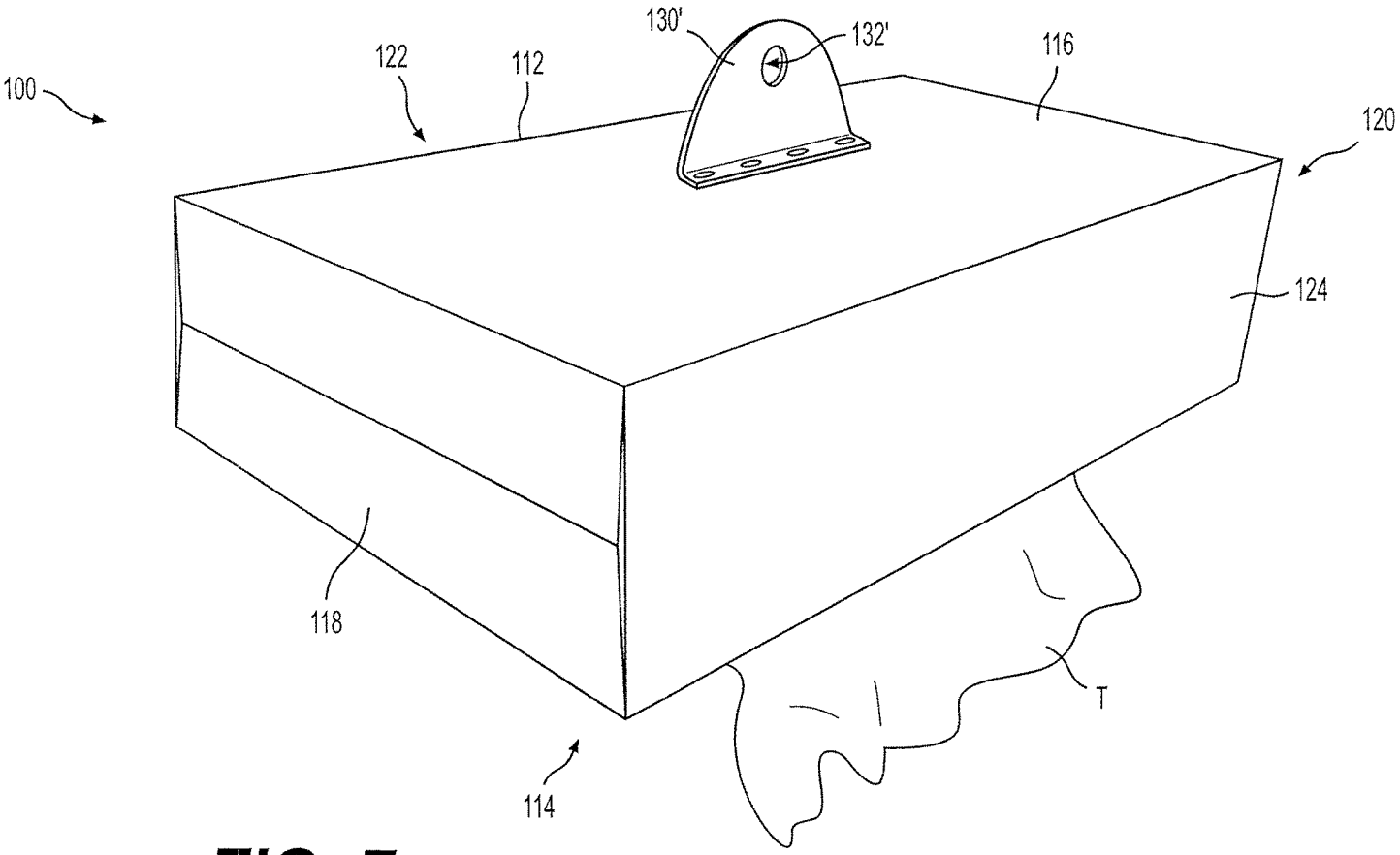
FIG. 7 is a perspective view of an alternative embodiment of a tissue box with improved tissue dispensing having a single hanging tab centrally located on the bottom wall of the box for suspending the box upside down.

In the alternative embodiment shown in FIGS. 5-7, a tissue box with a hanging tab 100 is provided. The tissue box with a hanging tab 100 includes a tissue box 112 having a top wall 114, a bottom wall 116, a pair of longitudinally opposed sidewalls or end walls 118, 120, and a pair of laterally opposed sidewalls 122, 124. A longitudinally extending slot 126 is formed through the top wall 114. A hanging tab 130 is secured to the tissue box 112. The hanging tab 130 has an aperture 132 defined therein and is adapted for releasable hanging from an external support, such as a wall hook or the like.

As shown in FIGS. 5 and 6, the hanging tab 130 may be a double layer of nylon, including a first layer 134 and a second layer 136, respectively. It should be understood that the hanging tab 130 may be secured to any suitable portion of the tissue box 112. For example, as shown in FIGS. 5 and 6, a strip of the first layer 134 may be secured to one of the pair of laterally opposed sidewalls, such as sidewall 124, and a strip of the second layer 136 may be secured to the bottom wall 116, thereby securing the hanging tab 130 to a corner edge of the box 112 formed by the sidewall 124 and the bottom wall 116. The flexible nature of layers 134, 136 allows this configuration to be used in multiple ways. For example, with the first and second layers 134, 136 bent parallel to bottom wall 116, as in FIG. 5, the tissue box 100 may be hung such that tissues T are removed horizontally. Alternatively, with the first and second layers 134, 136 bent parallel to sidewall 124, as in FIG. 6, the tissue box 100 may be hung so that the box is suspended upside down and tissues T are removed vertically with a downward pull. As a further alternative, as shown in FIG. 7, the hanging tab 130' may be formed from a single strip of material or both layers may be bent in the same direction, the hanging tab 130' also having an aperture 132' formed therein and, similarly, may be secured to any suitable portion of the tissue box 112. For example, in the example of FIG. 7, the hanging tab 130' is positioned substantially centrally with respect to the bottom wall 116, and may be secured thereto by adhesive or a strip of adhesive tape, for example.

Figure 8:
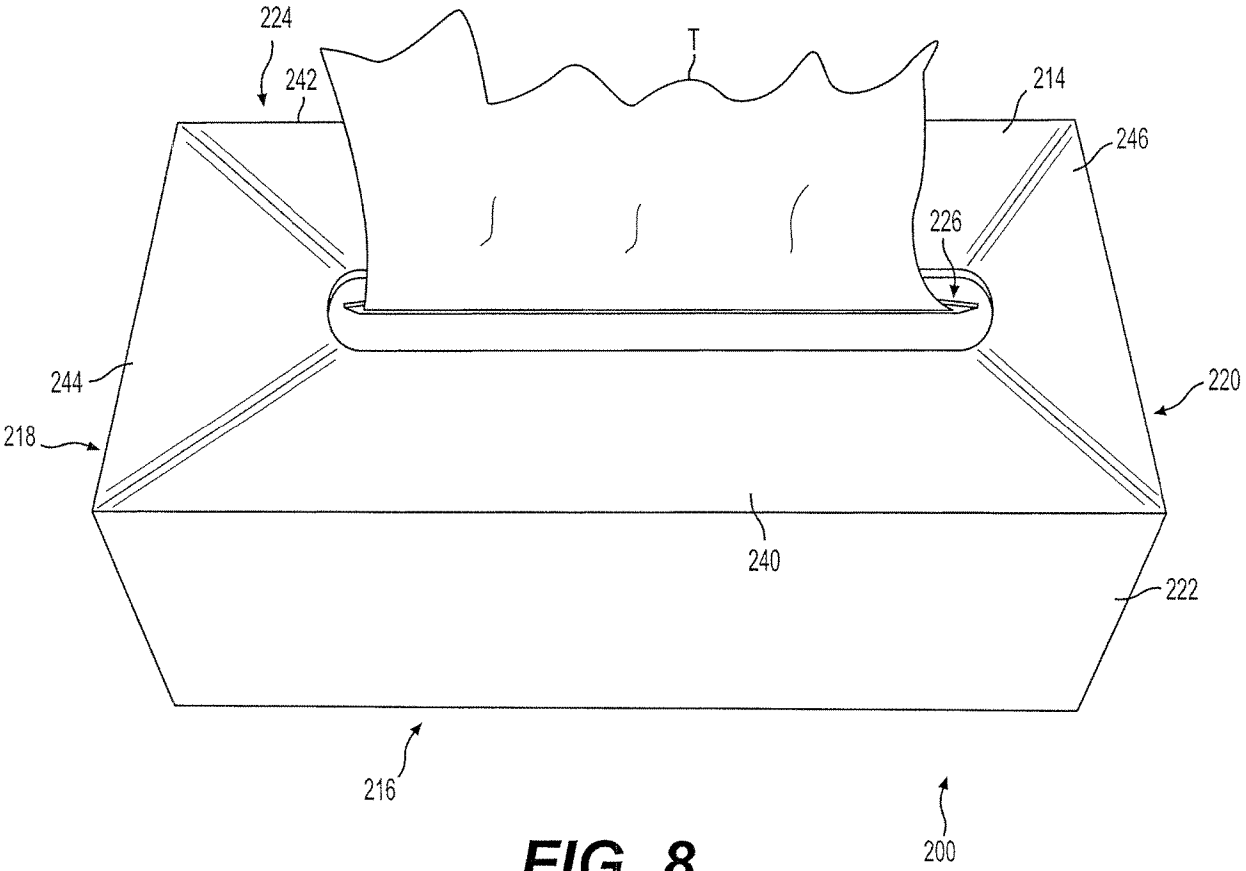
FIG. 8 is a perspective view of a further alternative embodiment of a tissue box with improved tissue dispensing having a pyramidal top wall.
Figure 9:
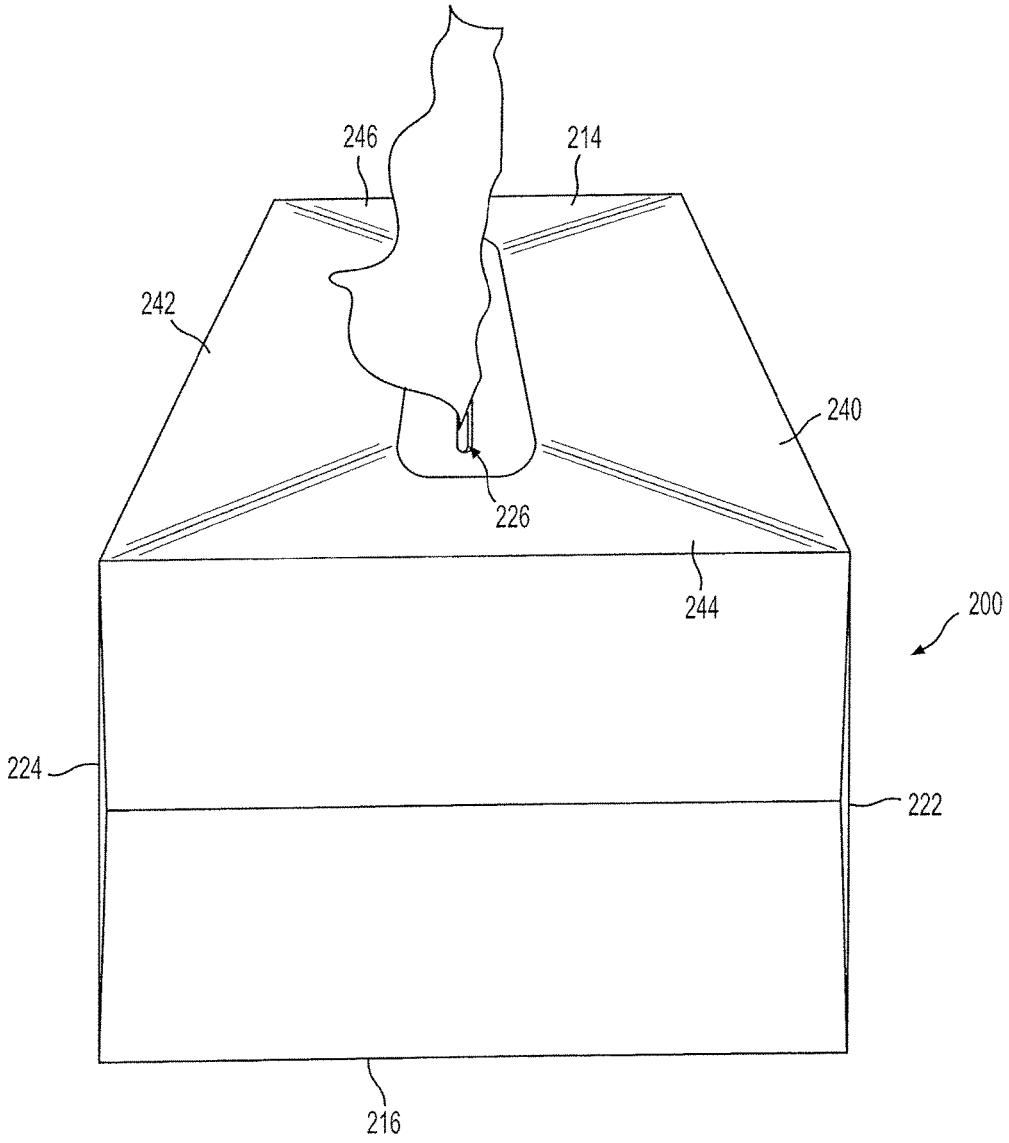
FIG. 9 is a perspective view of the tissue box of FIG. 8 as seen from an end of the box.

In the further alternative embodiment of FIGS. 8 and 9, the tissue box 200 has a top wall 214 having a truncated pyramidal shape, providing more room inside for the user to engage with or manipulate the tissues T stored within the tissue box 200 to remove the tissue without tearing the tissue. The tissue box 200 also includes a bottom wall 216, a pair of longitudinally opposed sidewalls or end walls 218, 220, and a pair of laterally opposed sidewalls 222, 224, and has a longitudinally extending slot 226 formed through the top wall 214. The truncated pyramidal shape of the top wall 214 may be defined by a pair of longitudinally opposed generally triangular panels 244, 246, and a pair of laterally opposed trapezoidal panels 240, 242.

Figure 10:
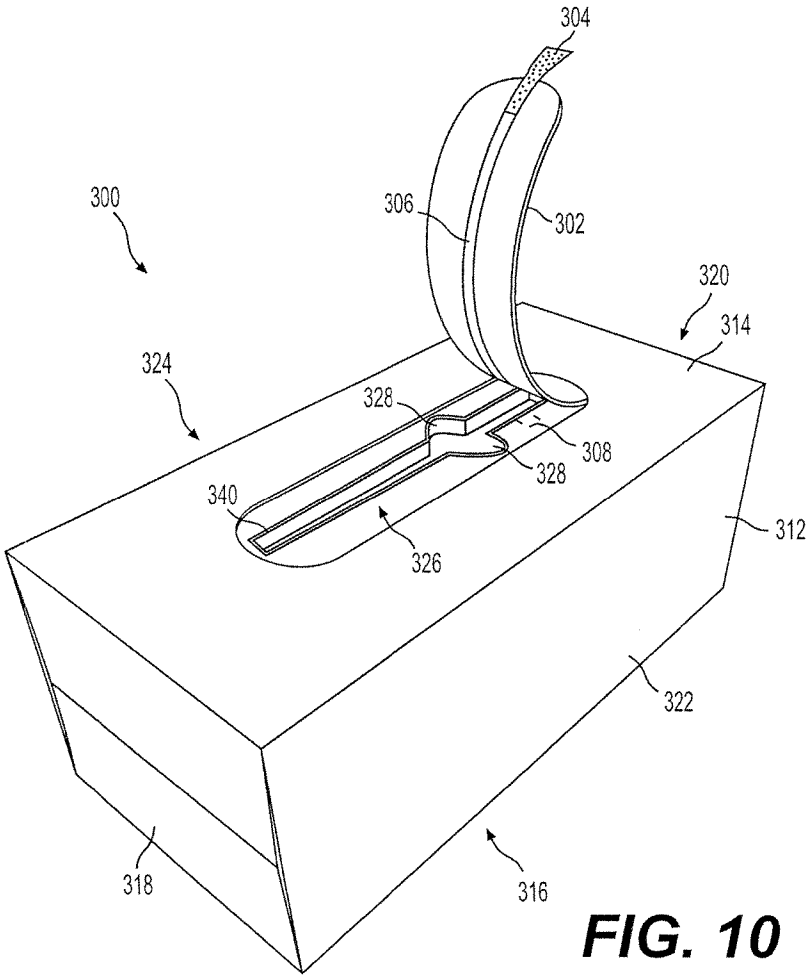
FIG. 10 is a perspective view of another alternative embodiment of a tissue box with improved tissue dispensing having symmetrical recessed cutouts on opposite sides of the slit.

In the further alternative embodiment of FIG. 10, a tissue box 300 with a removable dispensing cover is provided. The tissue box 300 includes a box 312 having a top wall 314, a bottom wall 316, a pair of longitudinally opposed sidewalls or end walls 318, 320, and a pair of laterally opposed sidewalls 322, 324. A longitudinally extending slot 326 is formed through the top wall 314. A nylon cover having a slit defined therein may extend across the slot, and a pair of additional recesses 328 may be provided symmetrically on either side of the slit, providing additional space for a tissue to be removed from the slot 326 through the slit in the nylon cover, thus minimizing twisting or shearing forces applied to the tissue. Further, an adhesive border 340 may be provided about to the nylon cover adjacent the slit in order to prevent tissues from accidentally falling back into the tissue box 312 after they have been dispensed.

A removable dispensing cover 302 is provided, which is preferably constructed from the same material as the tissue box 312. In order to enable removal of the removable dispensing cover 302 from the tissue box 312, the top wall 314 is preferably perforated to form or outline the shape of cover 302 to permit a user to selectively tear the cover 302 away. A pull tab 304 extends from one end of the cover 302. The pull tab 304 provides a handle for the user to grab onto in the process of tearing or removing the cover 302 from the tissue box 312. Further, an elongated length of dispensing string, thread, or wire 306 is attached to the bottom of the cover 302 by an adhesive or the like. The dispensing string 306 extends from a terminal end of the pull tab 304 along the length of the cover 302.

Figure 11:
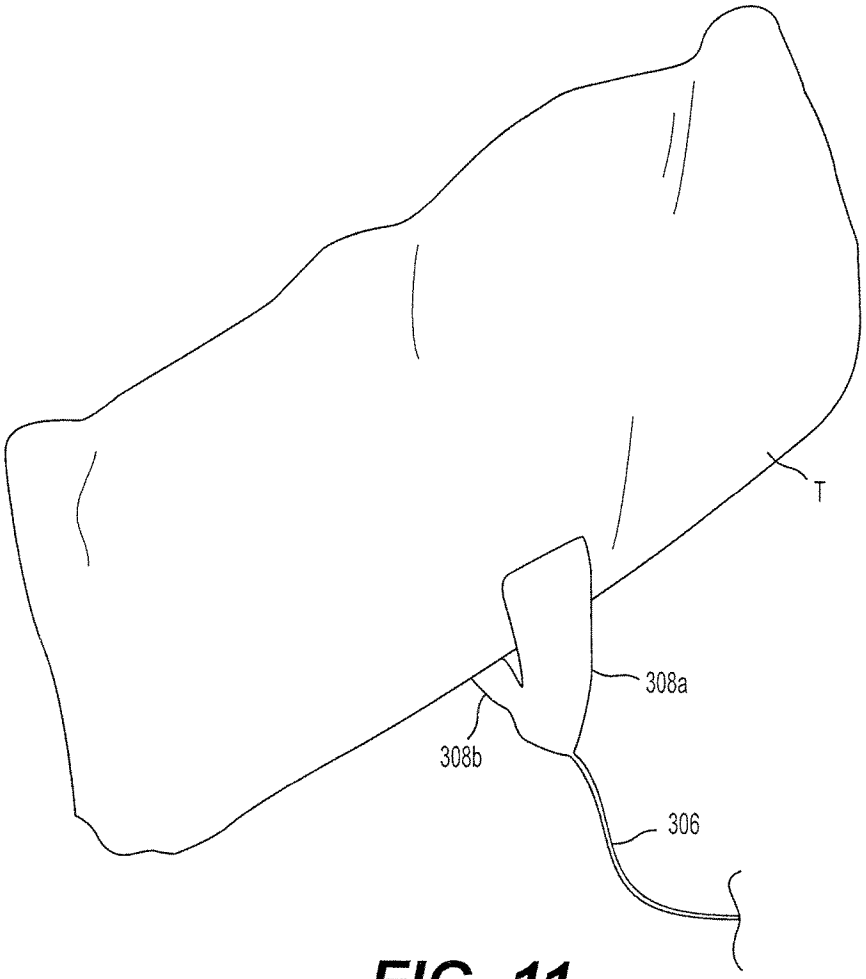
FIG. 11 is partial perspective view of a tissue box with improved tissue dispensing having a two-piece adhesive pad for grasping a tissue on both sides.

A dispensing strip 308 is attached to a free portion of the dispensing thread 306, as shown. The dispensing strip 308 is configured to be attached, through an adhesive or the like, to the top sheet or sheets of paper tissue contained in the tissue box 312. The dispensing strip 308 grasps the top tissue sheet so that the top tissue sheet is pulled as the dispensing string 306 is pulled. The dispensing strip 308 may also be provided as a drop of deformable adhesive and the like. In FIG. 10, the dispensing strip 308 is shown as a simple singular member. However, as shown in FIG. 11, the dispensing strip may be alternatively provided in the form of pair of sheets 308*a*, 308*b*, each adhesively grasping the tissue T from either side.

Figure 12:
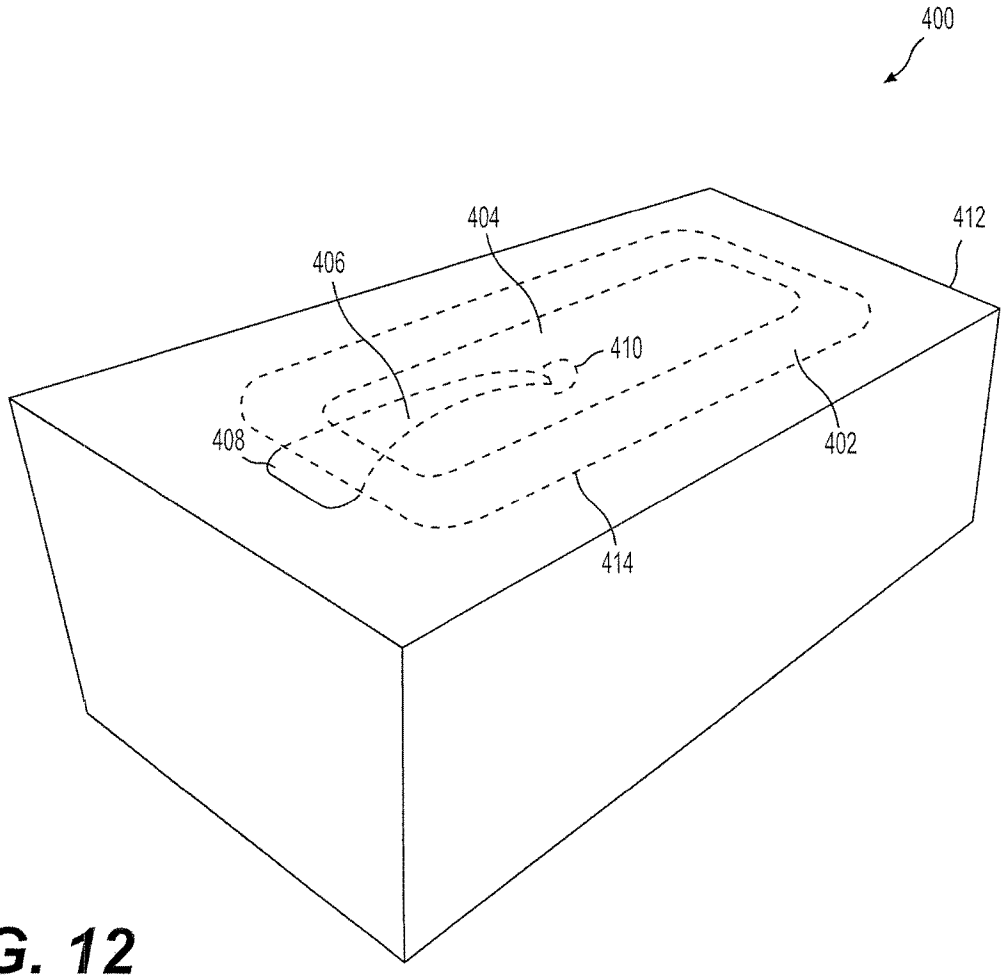
FIG. 12 is a perspective view of an alternative embodiment of a tissue box with improved tissue dispensing having a removable dispensing cover.

In the further alternative embodiment of FIG. 12, a tissue box with a removable dispensing cover 400 is provided. In the embodiment of FIG. 12, a removable dispensing cover 402 is provided with an adhesive strip 404 formed on the underside thereof. In this embodiment, the dispensing string 306 of the previous embodiment is replaced by a strip 406. A grasping tab 408 is secured to an external end of dispensing strip 406, as shown, with an attachment member 410 (similar to dispensing strip 308 of the previous embodiment) secured to an opposed internal end. A central portion of the strip 406 is at least partially secured to the adhesive strip 404. Thus, as the user removes cover the 402 from the tissue box 412 (via perforations 414 or the like), assisted by the grasping tab 408, the dispensing strip 406 will act to pull the topmost tissue through the dispensing slot as the cover 402 is removed.

It will be understood that although various embodiments have been described separately in order to more clearly describe their novel features, the tissue box with improved tissue dispensing may comprise a tissue box combining the features of the various embodiments herein, e.g., the tissue box may comprise the pyramidal top wall FIGS. 8-9, the hanging tab of FIG. 5, and the finger cot of FIGS. 1-4.

It is to be understood that the tissue box with improved tissue dispensing is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A tissue box with improved tissue dispensing, comprising:

a tissue box having a top wall, a bottom wall, a pair of longitudinally opposed end walls, and a pair of laterally opposed sidewalls, the top wall having a longitudinally extending slot defined therein adapted for dispensing tissues through the slot, the tissue box defining an interior adapted for containing the tissues;

a finger cot having a closed end and an open end, the closed end being positioned adjacent the longitudinally extending slot; and a resilient, flexible band having first and second longitudinally opposed ends, the first end being secured to the top wall of the tissue box and the second end being secured to the open end of the finger cot, whereby the finger cot is adapted for receiving a fingertip of a user so that the finger cot may be inserted into the interior of the tissue box through the longitudinally extending slot for engaging and manipulating a topmost one of the tissues contained therein.

2. The tissue box with improved tissue dispensing as recited in claim 1, wherein the closed end of the finger cot is at least partially coated with adhesive for selective adhesive engagement with the a topmost one of the tissues contained in the tissue box.

3. The tissue box with improved tissue dispensing as recited in claim 2, further comprising a releasable paper for selectively covering the finger cot.

4. The tissue box with improved tissue dispensing according to claim 1, wherein said top wall has a pyramidal configuration raising the longitudinal slot above the tissues contained in the interior of the tissue box.

5. The tissue box with improved tissue dispensing according to claim 4, further comprising a hanging tab extending from a corner edge of the tissue box parallel to the bottom wall, the hanging tab being adapted for suspending the tissue box from a support with the longitudinally extending slot disposed horizontally.

6. The tissue box with improved tissue dispensing according to claim 5, wherein said hanging tab is made from a double layer of nylon, the hanging tab having an aperture defined therein adapted for suspending the tissue box from a hook.

7. The tissue box with improved tissue dispensing according to claim 4, further comprising a hanging tab extending from a corner edge of the tissue box parallel to one of the sidewalls, the hanging tab being adapted for suspending the tissue box from a support with the longitudinally extending slot disposed downward.

8. The tissue box with improved tissue dispensing according to claim 4, further comprising a hanging tab extending from a central region of the bottom wall of the tissue box, the hanging tab being adapted for suspending the tissue box from a support with the longitudinally extending slot disposed downward.

9. The tissue box with improved tissue dispensing according to claim 1, further comprising a hanging tab extending from a corner edge of the tissue box parallel to the bottom wall, the hanging tab being adapted for suspending the tissue box from a support with the longitudinally extending slot disposed horizontally.

10. The tissue box with improved tissue dispensing according to claim 9, wherein said top wall has a pyramidal configuration raising the longitudinal slot above the tissues contained in the interior of the tissue box.

11. The tissue box with improved tissue dispensing according to claim 1, further comprising a nylon cover having a slit defined extending across the slot in the top wall, the nylon cover having a pair of recesses disposed symmetrically on either side of the slit, the recesses providing additional space for a tissue to be removed from the slot through the slit in the nylon cover.

12. The tissue box with improved tissue dispensing according to claim 11, wherein said top wall has a pyramidal configuration raising the longitudinal slot above the tissues contained in the interior of the tissue box.

13. The tissue box with improved tissue dispensing according to claim 12, further comprising a first hanging tab extending from a corner edge of the tissue box parallel to the bottom wall, the first hanging tab being adapted for suspending the tissue box from a support with the longitudinally extending slot disposed horizontally, and a second hanging tab extending from a corner edge of the tissue box parallel to one of the sidewalls, the second hanging tab being adapted for suspending the tissue box from a support with the longitudinally extending slot disposed downward.

14. The tissue box with improved tissue dispensing according to claim 11, further comprising an adhesive border disposed about to the nylon cover adjacent the slit in order to prevent tissues from accidentally falling back into the interior of the tissue box after they have been dispensed through the slit.

15. A tissue box with improved tissue dispensing, comprising:

a tissue box having a top wall, a bottom wall, a pair of longitudinally opposed end walls, and a pair of laterally opposed sidewalls, the top wall having a longitudinally extending slot defined therein;

a hanging tab secured to the tissue box, the hanging tab having an aperture defined therein, the hanging tab being adapted for suspending the tissue box from an external support;

a finger cot having a closed end and an open end, the closed end being positioned adjacent the longitudinally extending slot; and a resilient, flexible band having first and second longitudinally opposed ends, the first end being secured to the top wall of the tissue box and the second end being secured to the open end of the finger cot, whereby the finger cot is adapted for receiving a fingertip of a user so that the finger cot may be inserted into the interior of the tissue box through the longitudinally extending slot for engaging and manipulating a topmost one of the tissues contained therein.

16. The tissue box with improved tissue dispensing according to claim 15, wherein said hanging tab is made from a double layer of nylon.

17. The tissue box with improved tissue dispensing according to claim 15, wherein said top wall has a pyramidal configuration raising the longitudinal slot above the tissues contained in the interior of the tissue box.

* * * * *